United States Patent [19]

Warkentin

[11] 4,200,321

[45] Apr. 29, 1980

[54] SANITATION DEVICE

[76] Inventor: Ralph Warkentin, Rte. 2, Box 2012, Burleson, Tex. 76028

[21] Appl. No.: 885,479

[22] Filed: Mar. 13, 1978

[51] Int. Cl.[2] ..... A01K 29/00

[52] U.S. Cl. ..... 294/1 BA; 15/104.8

[58] Field of Search ..... 294/1 R, 19 R, 20, 22, 294/50.8, 50.9, 55; 15/104.8, 257.1, 257.2, 257.3, 257.6, 257.7

[56] References Cited

U.S. PATENT DOCUMENTS

| | | | |
|---|---|---|---|
| 1,669,302 | 5/1928 | Lanman | 15/104.8 |
| 3,105,715 | 10/1963 | Happ | 294/19 R X |
| 3,139,299 | 6/1964 | Bowen | 294/55 |
| 3,431,008 | 3/1969 | Narita | 294/55 |
| 3,757,737 | 9/1973 | Drum et al. | 294/55 X |
| 3,778,097 | 12/1973 | Dorzan | 294/1 R X |
| 3,804,448 | 4/1974 | Schmieler | 294/19 R |

FOREIGN PATENT DOCUMENTS

| | | | |
|---|---|---|---|
| 288314 | 9/1931 | Italy | 15/257.6 |
| 150844 | 9/1920 | United Kingdom | 294/50.9 |

*Primary Examiner*—Johnny D. Cherry
*Attorney, Agent, or Firm*—William R. Laney

[57] ABSTRACT

An improved sanitation device for the collection of animal feces is provided. The device includes a longitudinal frame, a handle attached to one end of the frame, and a receptacle attached to the other end of the frame and having a first and second open end. A scoop arm is pivotally attached to an intermediate portion of the frame. A scoop is attached to the scoop arm and constructed and oriented for engagement and registry with an open end of the receptacle when the device is in a closed position. A spring between the scoop arm and the frame forcibly urges the two apart. A trigger is provided for actuating the scoop arm and is held by a trigger retainer at a convenient position relative to the handle so that the handle may be grasped by a hand while engaging the trigger with the fingers. A disposable receptacle detachably engages the second open end of the intermediate receptacle.

12 Claims, 4 Drawing Figures

SANITATION DEVICE

BACKGROUND OF THE INVENTION

1. Field of the Invention

This invention relates generally to apparatus for the collection and disposal of animal feces.

2. Description of the Prior Art (Prior Art Statement)

The following statement is intended to be a Prior Art Statement in compliance with the guidance and requirements of 37 CFR sections 1.56, 1.97 and 1.98 and with section 609 of the Manual of Patent Examining Procedure.

The most relevant prior arts known to applicant include U.S. Pat. No. 3,977,715 to Casci; U.S. Pat. No. 3,778,097 to Dorzan; U.S. Pat. No. 3,757,737 to Drum; U.S. Pat. No. 3,431,008 to Narita; and U.S. Pat. No. 3,986,744 to Krogstad et al.

Both the Casci and Dorzan patents show two-armed sanitation devices each having a scoop attached to one arm and a receptacle means attached to the second arm.

Drum shows a sanitation device having a receptacle attached to a longitudinal frame and having pick-up means actuated by a movable lever.

Narita shows a sanitation device having a receptacle means attached to the end of a longitudinal frame and having a lid on said receptacle means actuated by a lever attached to the upper end of the longitudinal frame.

Krogstad, et al. shows a sanitation device having a disposable receptacle retained thereon by means of an elastic band.

Other prior art references showing sanitation devices for the collection of animal fecal material and other refuse include:

U.S. Pat. No. 3,984,139—Battaglia
U.S. Pat. No. 3,937,509—Hufnagel
U.S. Pat. No. 3,912,316—Veech
U.S. Pat. No. 3,879,079—Nicholas
U.S. Pat. No. 3,872,831—Cassidy
U.S. Pat. No. 3,868,135—Magliaro
U.S. Pat. No. 3,854,578—Sharpe
U.S. Pat. No. 3,841,686—Gallo et al.
U.S. Pat. No. 3,799,598—Lavaggi
U.S. Pat. No. 3,754,785—Anderson
U.S. Pat. No. 3,733,098—Tobias
U.S. Pat. No. 3,688,483—Hamilton
U.S. Pat. No. 3,139,299—Bowen It is seen that there has been considerable effort made in the prior art to achieve a convenient, economically constructed, sanitary and socially acceptable apparatus for the collection of refuse, and particularly of animal fecal material. There is a particular need for such a device in our cities where pollution of the streets by animal excrement is a major problem. All of the devices previously known to the prior art have had several deficiencies however. Many have been awkward in their operation and unsanitary in their ultimate means of disposing of the refuse.

Casci provides no means for retaining the refuse in a totally enclosed manner prior to ultimate disposition. This may allow the refuse to be spilled should the device be dropped. Furthermore, the disposable receptacle used in Casci is of an unusual design which must be specially fabricated for that device.

Similar deficiencies are seen in Dorzan and Drum. Furthermore, the apparatus of Drum does not provide a positive means for scooping up the refuse, but rather the refuse is "flipped" into the receptacle which necessarily means that at least small portions of the refuse will be scattered about in an undesirable manner.

The Narita apparatus is deficient in that it does not include a positive means for scooping up the refuse, but rather the refuse is pushed into a receptacle, thereby tending, undesirably, to spread the refuse upon the ground.

Krogstad shows the further deficiency of a device which cannot be operated from a standing position, but which requires that the operator stoop to reach the ground surface.

SUMMARY OF THE INVENTION

An improved sanitation device for the collection of animal feces is provided. The device is comprised of a longitudinal frame, a handle attached to the first end of said frame and an intermediate receptacle having first and second open ends attached to the other end of the frame. A scoop arm is pivotally attached to an intermediate portion of the frame and a scoop is attached to the scoop arm and is constructed and oriented for engagement and registry with an open end of the intermediate receptacle when the device is in a closed position. Spring means is located between the scoop arm and the frame for forcibly urging the two apart and trigger means is provided for actuating the scoop arm. A trigger retaining means holds the trigger means at a convenient position relative to the handle so that the handle may be grasped by a hand while engaging the trigger means with the fingers. A disposable receptacle detachably engages the second open end of the intermediate receptacle.

It is therefore the general object of the present invention to provide an apparatus for the collection and disposal of ground litter, and in a particularly useful application, animal feces.

A further object of the present invention is to provide an improved sanitation device having disposable receptacle means connected thereto and so constructed as to prevent contact of the external surface of said disposable receptacle means with the material to be collected.

Another object of the present invention is to provide an improved actuating means for a sanitation device.

Yet another object of the present invention is the provision of a sanitation device which may be locked in a closed position to retain collected material therein prior to the disposition of the same.

Other and further objects, features and advantages of the present invention will be readily apparent to those skilled in the art upon a reading of the description of preferred embodiments which follows, when taken in conjunction with the accompanying drawings.

DETAILED DESCRIPTION OF THE PREFERRED EMBODIMENTS OF THE INVENTION

Figure 1:
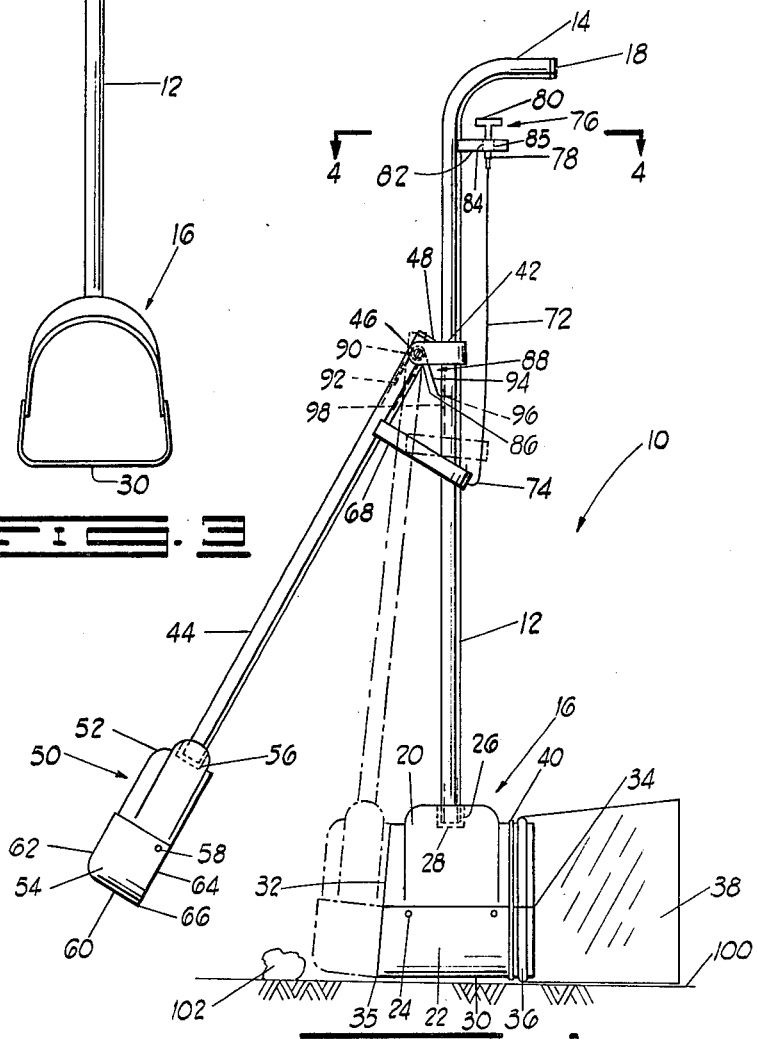
FIG. 1 is a side elevational view of the sanitation device of the present invention, showing the device in an open position in solid lines and in a closed position in phantom lines.

Referring now to the drawings and particularly to FIG. 1, the sanitation device of the present invention is illustrated and generally designated by the numeral 10. The sanitation device 10 is comprised of a longitudinal frame element 12 having a handle 14 attached at one end thereof and an intermediate receptacle 16 attached at the other end thereof. The longitudinal frame 12 is of tubular construction, as is the handle 14 which is a continuous portion of the longitudinal frame which has been bent over to extend at approximately a right angle from the longitudinal frame. In the outer end of the tubular handle 14 is a plug 18 which closes the end thereof. The tubular frame 12 and handle 14 are preferably made of metal. The plug 18 is preferably made of plastic and of such dimensions that it snugly fits into the end of the handle 14, but is removable therefrom.

The intermediate receptacle 16 is preferably of a two piece construction, and includes an upper portion 20 and a lower portion 22. The upper and lower portions 20 and 22 are preferably constructed of plastic, and are joined together by means of a plurality of rivets 24. The upper portion 20 includes a frame receiving cup 26 in the top portion thereof. The frame receiving cup 26 is of cylindrical configuration having a closed end 28 at the bottom portion thereof and being open at the top portion. An end of the longitudinal cylindrical frame 12 is inserted in the frame receiving cup 26 and bottoms out on the closed end 28 thereof. The frame 12 snugly fits within the receiving cup 26. A rigid connection between the frame 12 and the receiving cup 26 is achieved by means of an adhesive such as glue with which the inner surface of the cup 26 and the outer surface of the end of the frame 12 are coated before the frame is inserted into the cup. As noted above, the frame receiving cup 26 includes the closed bottom portion 28 adjacent the open end of the tubular frame 12. This prevents the open end of the frame 12 from coming into contact with material collected by the sanitation device 10, and prevents any of the material collected by the device 10 from becoming stuck within the end of the frame 12. It will be appreciated that due to the noxious character of some material which may be collected by the device 10, this is a desirable feature.

The intermediate receptacle 16, as comprised of its upper and lower portions, 20 and 22, is seen to comprise a receptacle having a closed flat bottom portion 30 with closed sides and a closed top portion. The receptacle 16 has an open front end 32 and an open rear end 34. The bottom portion 30 has a smooth straight working edge 35 adjacent the front end 32. Adjacent the open rear end 34 is a ridge 36 which circumvallates the open rear end. Located adjacent the rear end 34 is a disposable receptacle 38 which is comprised of an open ended bag. The open end of the disposable receptacle 38 is fitted over the ridge 36 about the open end 34 of the intermediate receptacle 16 and is retained thereon by a suitable receptacle retaining means 40 which is preferably comprised of an elastic band.

At an intermediate location upon the frame 12 between the handle 14 and the intermediate receptacle 16, an arm mounting bracket 42 is rigidly attached. The bracket 42 is preferably formed of a metal strap which has been bent into a U-shaped configuration with the closed end of the U being wrapped around the cylindrical longitudinal frame 12, and the two legs of the bracket extending outwardly toward the front end of the device 10 in a direction normal to the longitudinal axis of the frame. The bracket 42 is attached to the frame 12 by welding or other suitable means.

A scoop arm 44 is pivotally attached to the bracket 42 by means of a bolt 46. The scoop arm 44 is of tubular construction similar to that of the longitudinal frame 12. The scoop arm 44 is a straight cylindrical member which is closed at the upper end thereof by a plastic plug 48 similar to the plug 18. Attached to the other end of the scoop arm 44 is a scoop 50. The scoop 50 is comprised of upper and lower portions 52 and 54 respectively. The upper portion 52 includes an arm receiving cup 56, similar in construction to the frame receiving cup 26, into which the lower end of the scoop arm 44 is inserted. The upper and lower portions, 52 and 54, of the scoop 50 are attached by a plurality of rivets 58 in the manner of connection of the upper and lower portions of the intermediate receptacle 16.

The scoop 50, as comprised of its upper and lower portions 52 and 54, has a relatively flat planar bottom surface 60, a closed front end 62, an open rear end 64, and closed sides and top portions. The bottom 60 of the scoop 50 has a relatively smooth straight working edge 66 adjacent the rear end 64 of the scoop.

Figure 2:
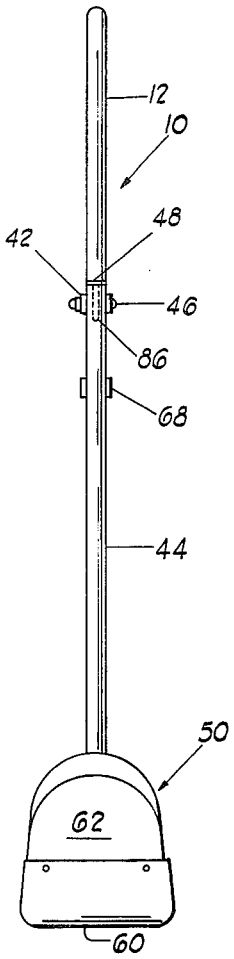
FIG. 2 is a front elevational view of the device of FIG. 1 in a closed position.
Figure 3:
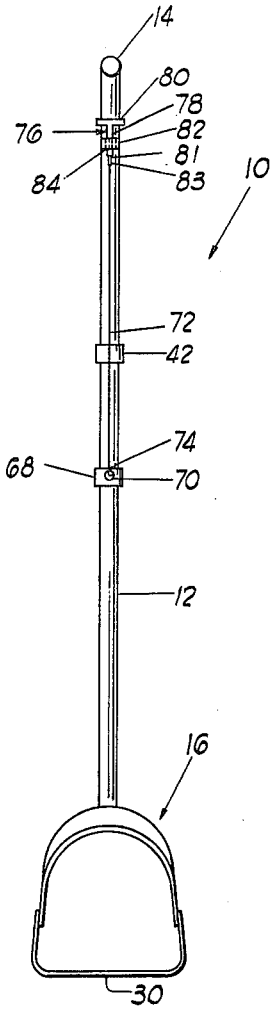
FIG. 3 is a rear elevational view of the sanitation device of the present invention in a closed position, the disposable receptacle having been removed.

Attached at an intermediate location upon the scoop arm 44 is a lever extension 68 which is comprised of a metal strap attached at one end to one side of the scoop arm 44 than formed into a U-shaped member wrapping around the longitudinal frame 12 and being attached at the other end to the other side of the scoop arm 44. In this manner, the pivotal movement of the scoop arm 44 about the pivot bolt 46, away from the frame 12, is limited by contact of the lever extension 68 with the frame 12. This limited pivotal movement outward from the frame 44 defines the open position of the sanitation device 10 as is seen in solid lines in FIG. 1. The lever extension 68 contains a hole 70 in its outer end, as seen in FIG. 3. An actuating line 72 is connected to the hole 70 of the lever extension 68 by means of a hook portion 74 formed upon an end of the actuating line and inserted in the hole. At the other end of the actuating line 72 is attached a trigger 76. The trigger 76 is preferably of a T-shaped configuration having a middle portion 78 and an end portion 80 attached perpendicular to one end thereof. The other end of the middle portion 78 includes a shoulder 81 and a reduced diameter end 83. Attached to the reduced diameter end 83 of the middle portion 78 is the actuating line 72.

Figure 4:
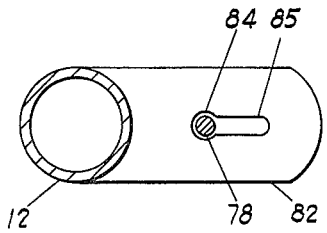
FIG. 4 is a sectional view taken along line 4—4 of FIG. 1.

Located on the frame 12 at a location between the bracket 42 and the handle 14 is a trigger bracket 82. The trigger bracket 82 is rigidly attached to the frame 12 and contains a hole 84 through which the middle portion 78 of the trigger 76 extends. Also contained in the trigger bracket 82 is a retaining slot 85, which communicates with the hole 84 and is so dimensioned as to be wider than the reduced diameter end 83, but narrower than the rest of the middle portion 78, so that when the trigger 76 is actuated the shoulder 81 may be abutted atop the slot 85, thereby holding the device 10 in a closed position. This configuration of the trigger bracket is illustrated in FIG. 4. It will be appreciated that the reduced diameter end 83 could be deleted and the same locking effect still achieved. The trigger bracket 82 is so located as to hold the trigger 76 at a location relative to the handle 14 such that the trigger is conveniently reached and operated by the fingers of a human hand while grasping the handle 14. When the trigger 76 is actuated, that is pulled upward towards the handle 14, it exerts a force through the actuating line 72 upon the lever extension 68 causing the scoop arm 44 to pivot in a counter-clockwise direction, as seen in FIG. 1, about the pivot bolt 46. In this manner, the device 10 is moved to the closed position as indicated by the phantom lines in FIG. 1. As described above, the device may be retained in a closed position by placing the shoulder 81 atop the slot 85.

The scoop arm 44, at its upper end adjacent the plug 48, contains a slot 86 in the rear surface of the scoop arm nearest the frame 12. The slot 86 extends from the plug 48 to a point below the pivot bolt 46. A spring 88 is positioned within the slot 86. The spring 88 has a loop portion 90 with a first extension 92 and a second extension 94. The loop 90 and the first extension 92 are located within the cylindrical tubular scoop arm 44, and the loop portion 90 is positioned around the pivot bolt 46. The first extension 92 engages the inner cylindrical surface of the scoop arm 44 at a position farthest away from the frame 12. The second extension 94 extends through the slot 86 and has a bent end 96 which fits within a spring receiving hole 98 which is disposed within the tubular frame 12. The spring 88 is so constructed as to forcibly urge the pivot arm 44 to pivot away from the frame 12. This holds the sanitation device 10 in an open position as seen in solid lines in FIG. 1 at all times when the trigger 76 is not actuated.

OPERATION OF THE DEVICE

In its operation, the sanitation device 10 provides a convenient and sanitary means for collecting and disposing of animal fecal material, or for picking up debris from the ground. Referring to FIG. 1, the mode of operation of the sanitation device 10 is as follows. With the device in the open position as shown by the solid lines in FIG. 1, the intermediate receptacle 16 is placed on a ground surface 100 with its open front end 32 adjacent, slightly spaced from and facing a deposit of fecal material 102 which it is desired to collect. The sanitation device 10 is then tilted slightly forward, rotating about the working edge 35 of the front of the bottom portion 30 of the receptacle 16. Then the trigger 76 is actuated to cause the scoop arm 44 to pivot toward the frame 12, thereby moving the scoop 50 towards the intermediate receptacle 16. Due to the fact that the sanitation device 10 has been tilted slightly forward, the working edge 66 of the scoop 50 will contact the ground surface 100 slightly forward of the location of the fecal material 102. Then as the trigger 76 is continually pulled upward, the sanitation device 10 is gradually tilted backwards permitting the working edge 66 of the scoop 50 to slide across the ground surface 100. In this manner, the working edge 66 slides under the fecal material 102 and carries it toward the intermediate receptacle 16. When the working edge 66 of the scoop 50 engages the working edge 35 of the intermediate receptacle 16, the open end 64 of the scoop 50 and the open front end 32 of the intermediate receptacle 16 are in registry, and the sanitation device is in the closed position as indicated by the phantom lines in FIG. 1.

The fecal material 102 is then entirely contained within the inner portions of the scoop 50 and the intermediate receptacle 16. The sanitation device 10 is then lifted up from the ground surface 100, and tilted backwards permitting the fecal material 102 to fall within the disposable receptacle 38. The fecal material is then permanently disposed of by removing the disposable receptacle 38 from about the intermediate receptacle 16 and depositing the same in a trash container. If it is desired to collect a plurality of deposits of fecal material 102, the sanitation device 10 can be locked in a closed position between collections by locking the trigger 76 in its actuated position by means of the shoulder 81 and the retaining slot 85.

As was described above, the spring 88 is so constructed as to forcibly urge the pivot arm 44 to pivot away from the frame 12. In this manner, when the trigger 76 is released the sanitation device returns to the open position.

It will be appreciated that in the operation described above, the intermediate receptacle 16 and its attached disposable receptacle 38 do not move relative to the ground 100 during the collection process. In this manner, the fecal material 102 may be collected without bringing it into contact with the outer surface of the disposable receptacle 38 or with that portion of the intermediate receptacle 16 immediately adjacent thereto. This prevents fouling of the outer surface of the disposable receptacle 38 and thereby allows sanitary removal thereof.

Thus, the sanitation device of the present invention is well adapted to carry out the objects and attain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A sanitation device for collecting animal feces and the like, comprising:

a longitudinal frame;

a receptacle, having a first open end, attached to one end of the frame;

an arm pivotally mounted upon an intermediate portion of the frame;

a scoop, mounted upon the arm and having an open end facing the receptacle; and trigger actuating means for pivoting the arm toward the frame such that the scoop moves in a scooping action for sliding under animal feces and carrying it toward the receptacle and moving the open end of the scoop into engagement with the first open end of the receptacle, the trigger actuating means extending from the frame to a portion of said arm between the pivotally mounted part of said arm and said scoop.

2. The sanitation device of claim 1 further comprising spring means connected between the longitudinal frame and the pivoted arm for urging the pivoted arm away from the longitudinal frame.

3. The sanitation device of claim 1 further comprising means for retaining the trigger actuating means in a position in which the open end of the scoop engages the first open end of the receptacle.

4. A sanitation device as described in claim 1 further comprising:

a handle, attached to the other end of the frame;

a trigger bracket for holding the trigger actuating means and attached to the frame intermediate of the handle and the receptacle and at a location facilitating grasping the trigger actuating means with the fingers of a human hand while grasping the handle.

5. The sanitation device of claim 4 wherein :

said trigger bracket is further characterized as including a hole for receiving the trigger actuating means; and wherein said trigger actuating means includes a T-shaped trigger having a middle portion, which is received in said hole in the trigger bracket, and an end portion, attached to one end of said middle portion, for grasping by the fingers of a human hand.

6. The sanitation device of claim 1 wherein:

said scoop is further comprised of a relatively flat planar bottom surface having a relatively smooth straight working edge adjacent the open end of the scoop; and said receptacle is further characterized as having a second open end opposite said first open end thereof, and having a relatively flat planar bottom surface with a relatively straight working edge adjacent the first open end thereof, so that when the sanitation device is in a closed position, the open end of the scoop and the first open end of the receptacle, and their respective working edges are in registry.

7. The device of claim 6 further comprising:

a ridge circumvallating the second open end of the receptacle;

a removable receptacle fitted over said ridge; and receptacle retaining means to removably hold said removable receptacle in place upon said second open end.

8. The apparatus of claim 1 wherein said receptacle is further comprised of a cylindrical frame receiving cup having a closed bottom portion and an open top portion and closely receiving an end of said longitudinal frame.

9. A sanitation device for scooping up animal feces from a ground surface comprising:

an elongated frame;

a handle attached to one end of the frame;

an intermediate receptacle attached to the other end of the frame, including a flat bottom portion for engaging the ground surface, first and second open ends, closed side and top portions, and a frame receiving cup in said top portion;

a scoop arm pivotally attached at one end to an intermediate portion of the frame;

a scoop, attached to the other end of the scoop arm, having a flat bottom portion, one open end facing the first open end of the intermediate receptacle, and closed second end, side and top portions;

a U-shaped lever arm, attached to the scoop arm, with the closed end thereof wrapped around the elongated frame so as to limit movement of the scoop arm away from the frame and thereby define the open position of the sanitation device;

trigger means for actuating the scoop arm;

means for retaining the trigger means in an actuated position;

an actuating member connecting the trigger means and the lever arm;

spring means, connected between the frame and the scoop arm, constructed to forcibly urge the one away from the other; and a disposable receptacle detachably engaging the second open end of the intermediate receptacle so that the fecal material scooped into the intermediate receptacle when the trigger means is actuated may be collected in the disposable receptacle for sanitary removal thereof.

10. A sanitation device for collecting animal feces and the like, comprising:

a longitudinal frame;

a receptacle, having an open end, attached to one end of the frame;

an arm pivotally mounted upon an intermediate portion of the frame;

a scoop, mounted upon the arm and having an open end facing the receptacle; and a handle, attached to the other end of the frame;

a T-shaped trigger;

a trigger bracket for holding the trigger and attached to the frame intermediate of the handle and the receptacle and at a location facilitating grasping the trigger with the fingers of a human hand while grasping the handle, said trigger bracket including a hole for receiving the trigger and a retaining slot communicating with said hole; and said trigger having a middle portion, which is received in said hole in the trigger bracket, and an end portion, attached to one end of said middle portion, for grasping by the fingers of a human hand, and a reduced diameter portion attached to the other end of said middle portion, the reduced diameter portion forming a shoulder for retaining the trigger in an actuated position by abutting the shoulder against said bracket adjacent said retaining slot.

11. A sanitation device for collecting animal feces and the like, comprising;

a longitudinal frame;

a receptacle, having an open end, attached to one end of the frame;

an arm pivotally mounted upon an intermediate portion of the frame;

a scoop, mounted upon the arm and having an open end facing the receptacle; and trigger actuating means connected between said arm and frame for pivoting the arm toward the frame and moving the open end of the scoop into engagement with the open end of the receptacle;

spring means connected between the longitudinal frame and the pivoted arm for urging the pivoted arm away from the longitudinal frame;

an arm mounting bracket, fixedly attached to said frame;

a pivot bolt, pivotally securing the arm to the arm mounting bracket; and said spring means having a loop portion positioned around the pivot bolt, a first extension engaging the arm, and a second extension engaging the longitudinal frame.

12. A sanitation device for collecting animal feces and the like comprising:

a longitudinal frame;

a receptacle, having a first open end, attached to one end of the frame;

an arm pivotally mounted upon an intermediate portion of the frame;

a scoop, mounted upon the arm and having an open end facing the receptacle;

a handle, attached to the other end of the frame;

a lever extension attached to an intermediate portion of the pivoted arm and positioned transverse thereto extending towards the longitudinal frame;

a trigger actuating means connected between said arm and said frame for pivoting the arm toward the frame such that the scoop moves in a scooping action toward the receptacle and moving the open end of the scoop into engagement with the first open end of the receptacle;

a trigger bracket for holding the trigger actuating means and attached to the frame intermediate of the handle and the receptacle at a location facilitating grasping the trigger actuating means with the fingers of a human hand while grasping the handle, said trigger bracket having a hole for receiving the trigger actuating means;

said trigger actuating means including a T-shaped trigger having a middle portion, which is received in said hole in the trigger bracket, and an end portion attached to one end of said middle portion, for grasping by the fingers of a human hand; and an actuating line, connected between the trigger and the lever extension, so that when the trigger is actuated a force is exerted upon the lever extension causing the arm to pivot towards the frame.

* * * * *